US009462878B1

(12) United States Patent
Filo et al.

(10) Patent No.: US 9,462,878 B1
(45) Date of Patent: Oct. 11, 2016

(54) SELF-CONTAINED, INTERACTIVE GAMING ORAL BRUSH

(71) Applicant: APPCESSORIES LLC, Novato, CA (US)

(72) Inventors: Andrew S. Filo, Cupertino, CA (US); David G Capper, Novato, CA (US)

(73) Assignee: APPCESSORIES LLC, Novato, CA (US)

( * ) Notice: Subject to any disclaimer, the term of this patent is extended or adjusted under 35 U.S.C. 154(b) by 0 days.

(21) Appl. No.: 14/628,133

(22) Filed: Feb. 20, 2015

Related U.S. Application Data

(60) Provisional application No. 61/942,535, filed on Feb. 20, 2014.

(51) Int. Cl.
*A46B 15/00* (2006.01)

(52) U.S. Cl.
CPC ..... *A46B 15/0006* (2013.01); *A46B 15/004* (2013.01); *A46B 15/0002* (2013.01); *A46B 15/0004* (2013.01); *A46B 15/0038* (2013.01)

(58) Field of Classification Search
CPC ..... A46B 15/0002; A46B 15/0004; A46B 15/0006; A46B 15/0008; A46B 15/0012; A46B 15/0038; A46B 15/004; A46B 15/0042; A46B 15/0044
See application file for complete search history.

(56) References Cited

U.S. PATENT DOCUMENTS 4,450,599 A * 5/1984 Scheller ..... A46B 15/0002 15/22.1
4,476,604 A * 10/1984 White ..... A46B 15/0002 15/105
5,282,291 A * 2/1994 Spieler ..... A46B 5/0062 15/105
5,331,707 A * 7/1994 Irizarry ..... A46B 15/0002 15/105
6,397,424 B1 * 6/2002 Leung ..... A46B 15/0002 15/105
8,544,131 B2 * 10/2013 Braun ..... A46B 15/0002 15/105
8,832,895 B2 * 9/2014 Jungnickel ..... A46B 5/0062 15/105
2004/0000017 A1 * 1/2004 Kumagai ..... A46B 15/0002 15/105
2005/0066461 A1 * 3/2005 Chang ..... A46B 15/0002 15/105
2005/0108841 A1 * 5/2005 Edwards ..... A46B 5/0062 15/167.1
2007/0261185 A1 * 11/2007 Guney ..... A46B 15/0002 15/22.1

(Continued)

FOREIGN PATENT DOCUMENTS

CA 2232528 * 9/1999
DE 19506129 * 8/1996

(Continued)

*Primary Examiner* — Mark Spisich
(74) *Attorney, Agent, or Firm* — Haverstock & Owens LLP

(57) ABSTRACT

An oral care brush includes a brush head coupled to a handle at an articulation point. A sensor is mounted for monitoring the articulation point to determine whether a brushing motion is proper. One or more tilt sensors can also be mounted in the handle to determine the orientation of the oral care brush relative to gravity. This orientation can also be used to determine proper brushing motion. A processor is mounted within the handle for receiving information from the sensors. A speaker in the handle is coupled to receive information from the processor and provide it to the user. The processor can also provide the user audio game-play scenarios using the speaker. The handle can also include one or more light sources.

20 Claims, 9 Drawing Sheets

(56) References Cited

U.S. PATENT DOCUMENTS

| | | | | |
|---|---|---|---|---|
| 2007/0270221 | A1* | 11/2007 | Park | A46B 15/0002 463/37 |
| 2009/0085724 | A1 | 4/2009 | Naressi | |
| 2010/0306685 | A1 | 12/2010 | Giaimo et al. | |
| 2012/0040758 | A1 | 2/2012 | Hosverth | |
| 2012/0198640 | A1* | 8/2012 | Jungnickel | A46B 15/0012 15/105 |
| 2013/0239104 | A1 | 9/2013 | Savant et al. | |
| 2014/0066209 | A1 | 3/2014 | Annambhotla | |

FOREIGN PATENT DOCUMENTS

| | | | |
|---|---|---|---|
| JP | 7-236519 | * | 9/1995 |
| JP | 9-322824 | * | 12/1997 |
| JP | 2004-105246 | * | 4/2004 |

* cited by examiner

SELF-CONTAINED, INTERACTIVE GAMING ORAL BRUSH

RELATED APPLICATIONS

This application claims benefit of priority under 35 U.S.C. section 119(e) of the U.S. Provisional Patent Application Ser. No. 61/942,535, filed Feb. 20, 2014, entitled "SMART TOOTHBRUSH," which is hereby incorporated by reference in its entirety.

BACKGROUND OF THE INVENTION

Brushing teeth is an important routine for persons to undertake each day. It is important that each person brush their teeth for a sufficient coverage and with appropriate motion to properly clean their teeth. Those skilled in the art will recognize that proper brushing technique is known as the Bass Method or the Fones Method. This practice is not only important for dental health, but also leads to improved overall health of the individual.

SUMMARY OF THE INVENTION

The present invention is directed toward an oral care brush. The brush includes a brush head having a plurality of bristles. Preferably, the brush head is a conventional toothbrush head such as found in commercially available toothbrushes. A handle is coupled to the brush head at an articulation point. A sensor is mounted for monitoring the articulation point. By sensing the motion of the articulation point the sensor can be used to determine whether a brushing motion is proper. One or more tilt sensors can also be mounted in the handle to determine the orientation of the oral care brush relative to gravity. This orientation can also be used to determine proper brushing motion.

A processor can be mounted within the handle for receiving information from the sensor. The processor acts upon the information from the sensor and runs an algorithm to analyze the brushing motion. A speaker in the handle is coupled to receive information from the processor. The information received by the speaker is used to provide audio feedback to a user regarding brushing technique.

The processor can also provide the user audio game-play scenarios using the speaker for enhancing their brushing experience. The handle can also include one or more light sources. Each of the one or more lights is preferably a visible light source. By watching the one or more light sources, such as in a bathroom mirror, the user can receive information about their brushing technique or game-play information.

The oral care brush of the present invention provides amusement to a person brushing their teeth. Additionally, the device will provide audible and visual signals in response to the brushing motion being employed. The device uses a sensitive brushing motion sensor and a tilt sensor to measure brushing actions as an input to a multi-mode game that responds to these motions and orientation. Preferably, the tilt sensor is a multi-axis tilt sensor. The response to the user takes the form of audible acoustic and visual annunciation. These responses provide sounds or lights for entertainment in the form of real time positive and negative feedback to the user.

The brushing action can be used as an input to entertainment software. The entertainment software can be gaming software. The device will reward the user for complete and effective motions and durations. The device can determine whether the user brushed in all portions of the mouth and with proper brush strokes.

DETAILED DESCRIPTION OF THE PREFERRED EMBODIMENT

In the following description, numerous details are set forth for purposes of explanation. However, one of ordinary skill in the art will realize that the invention can be practiced without the use of these specific details. Thus, the present invention is not intended to be limited to the embodiments shown but is to be accorded the widest scope consistent with the principles and features described herein.

Figure 1:
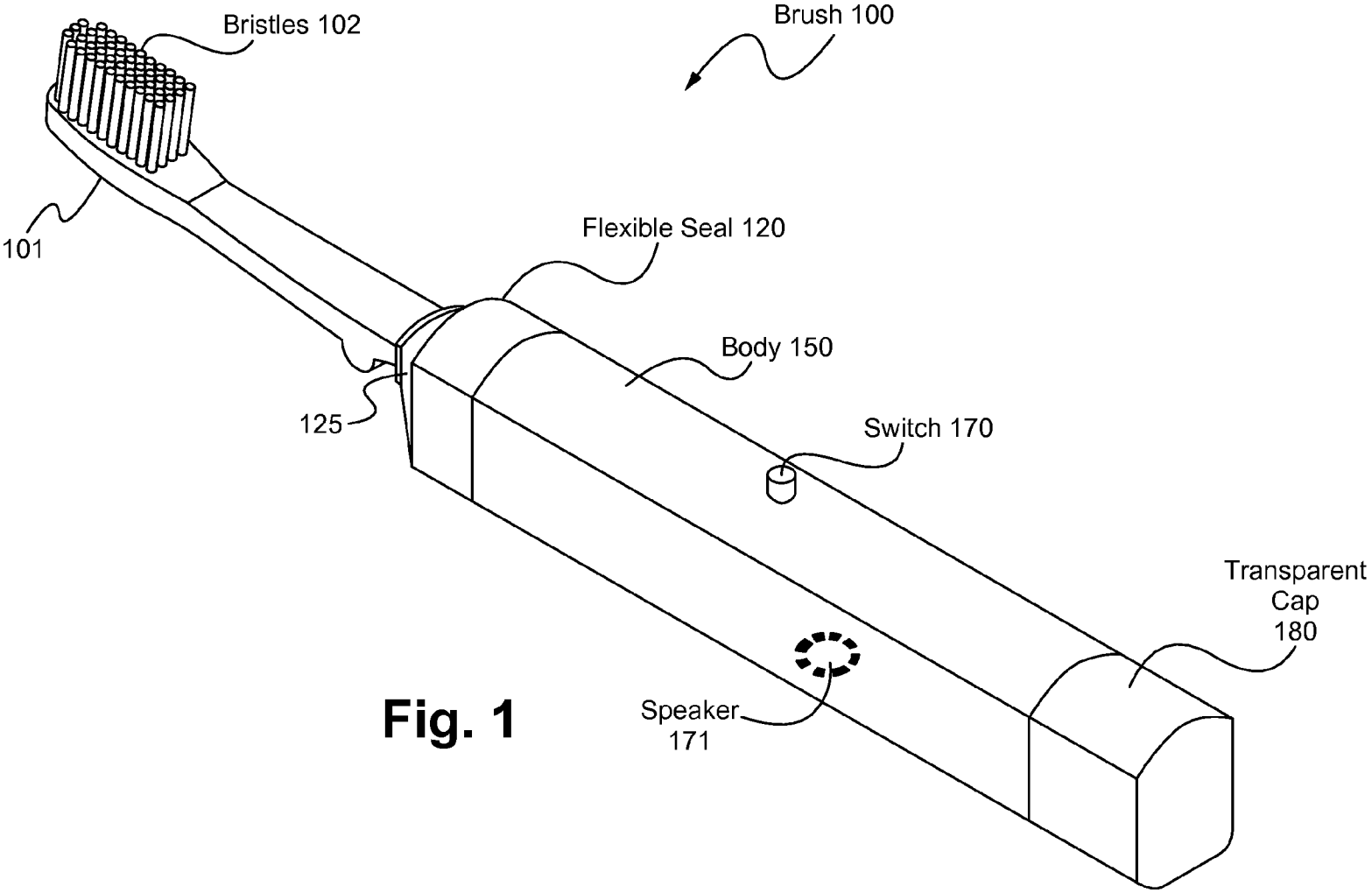
FIG. 1 shows an isometric view of the self-contained, interactive gaming oral brush of the present invention.

FIG. 1 shows an isometric view of the self-contained, interactive gaming oral brush 100 of the present invention. The brush 100 includes a brush head 101 that contains brush bristles 102. The bristles 102 are preferably conventional bristles. A body or handle 150 is coupled to the brush head 101 at an articulation 125. The articulation 125 will be discussed in more detail below. A flexible seal 120 is utilized to keep water, saliva and toothpaste from the brush head 101 from entering the handle 150. A transparent cap 180 is mounted to the handle 150 to allow light to escape from light sources in the handle 150. Alternatively, the cap 180 can be translucent. The transparent cap 180 is preferably mounted in the end of the handle 150 away from the brush head 101, but can be mounted at any convenient position on the brush handle 150. A switch 170 is provided in the handle 150 to activate and deactivate the brush assembly. A speaker 171 is mounted to allow sound to be provided to a user by the brush assembly. Desirably, the speaker 171 is fitted with a hydrophobic membrane that keeps water, saliva and toothpaste out of the speaker 171 and handle 150, while allowing sound to escape.

Figure 2:
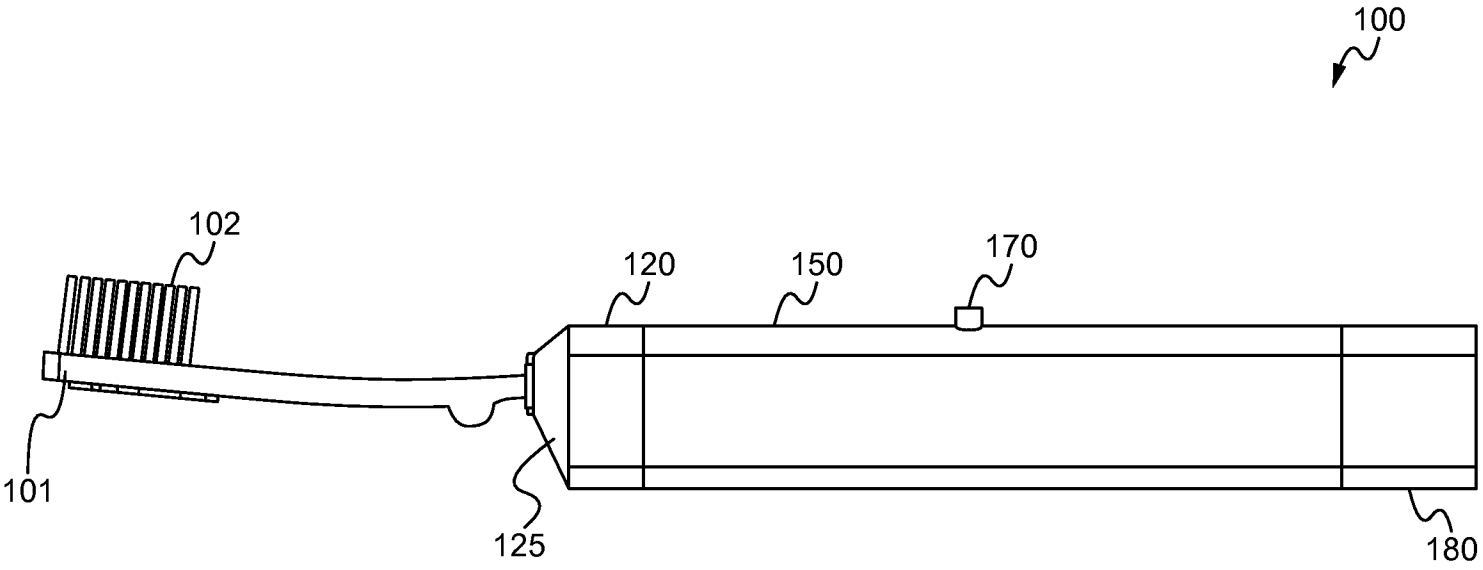
FIG. 2 shows a side view of the self-contained, interactive gaming oral brush of the present invention.
Figure 3:
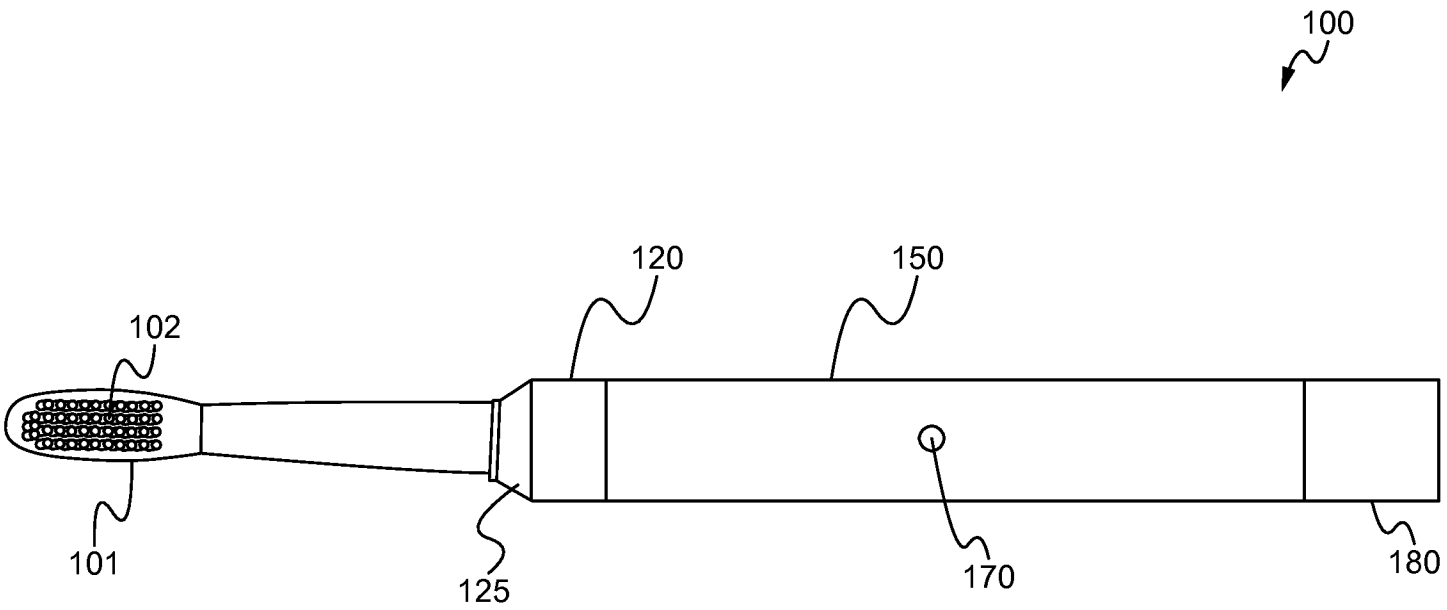
FIG. 3 shows a front view of the self-contained, interactive gaming oral brush of the present invention.

FIG. 2 shows a side view of the self-contained, interactive gaming oral brush 100 of the present invention. FIG. 3 shows a front view of the self-contained, interactive gaming oral brush 100 of the present invention. These views show the appropriate elements discussed relative to FIG. 1.

Figure 4A:
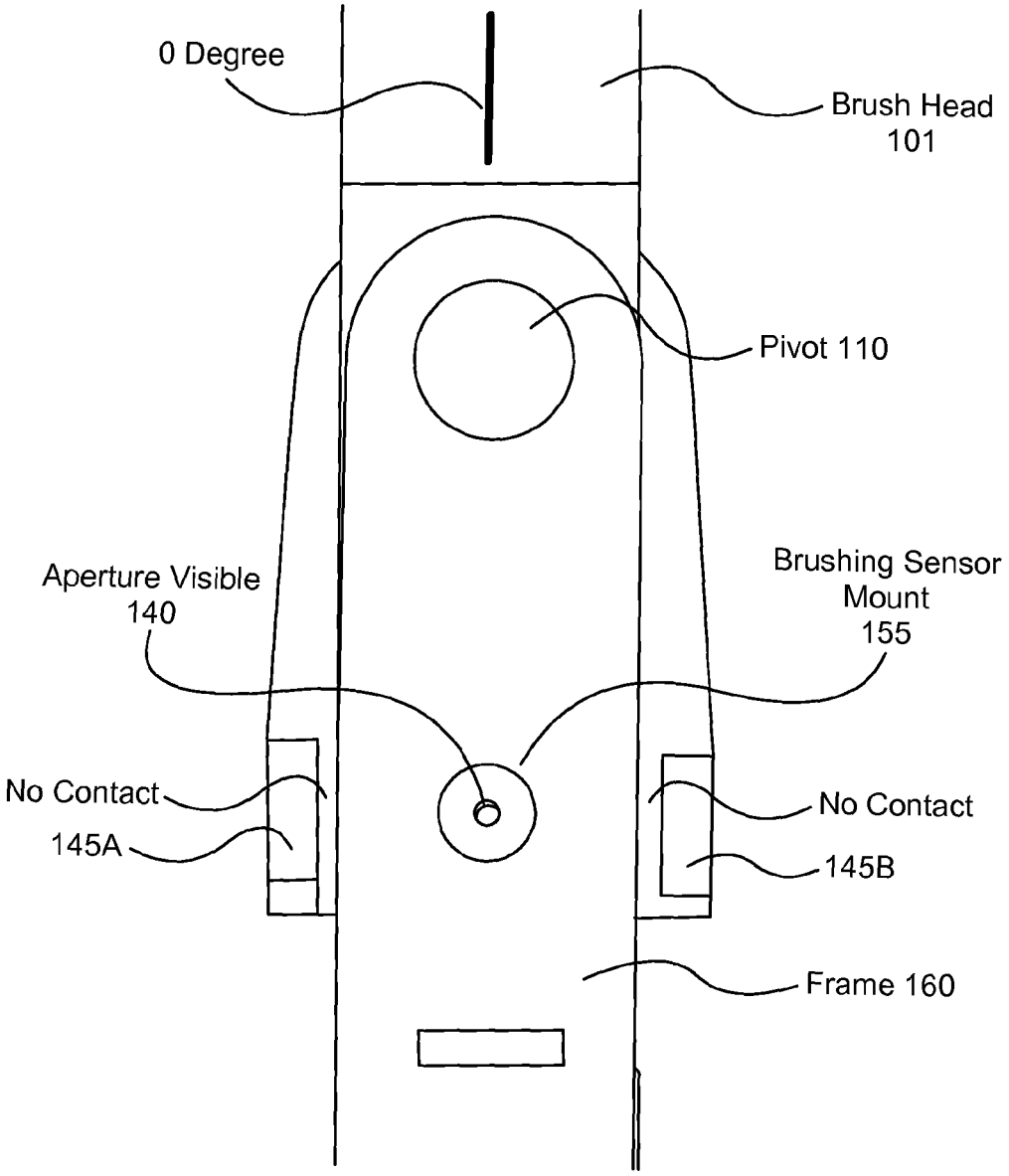
FIG. 4A shows a zero degree offset brushing sensor aperture.

FIG. 4A shows a zero degree offset brushing sensor aperture. The brush head 101 mounts to an internal frame 160 of the handle 150 on an articulation point. The articulation point includes a pivot 110 such that the brush head 101 and frame 160 can rotate relative to one another. The frame 160 includes contacts 145A-B which limit how far the brush head 101 can rotate relative to the frame 160. While the preferred embodiment shows the brush head 101 rotating relative to the contacts 145A-B in the frame 160, it will be apparent to one of ordinary skill in the art that the contacts 145A-B could be part of the brush head 101 and the frame 160 is stopped by them.

Figure 4B:
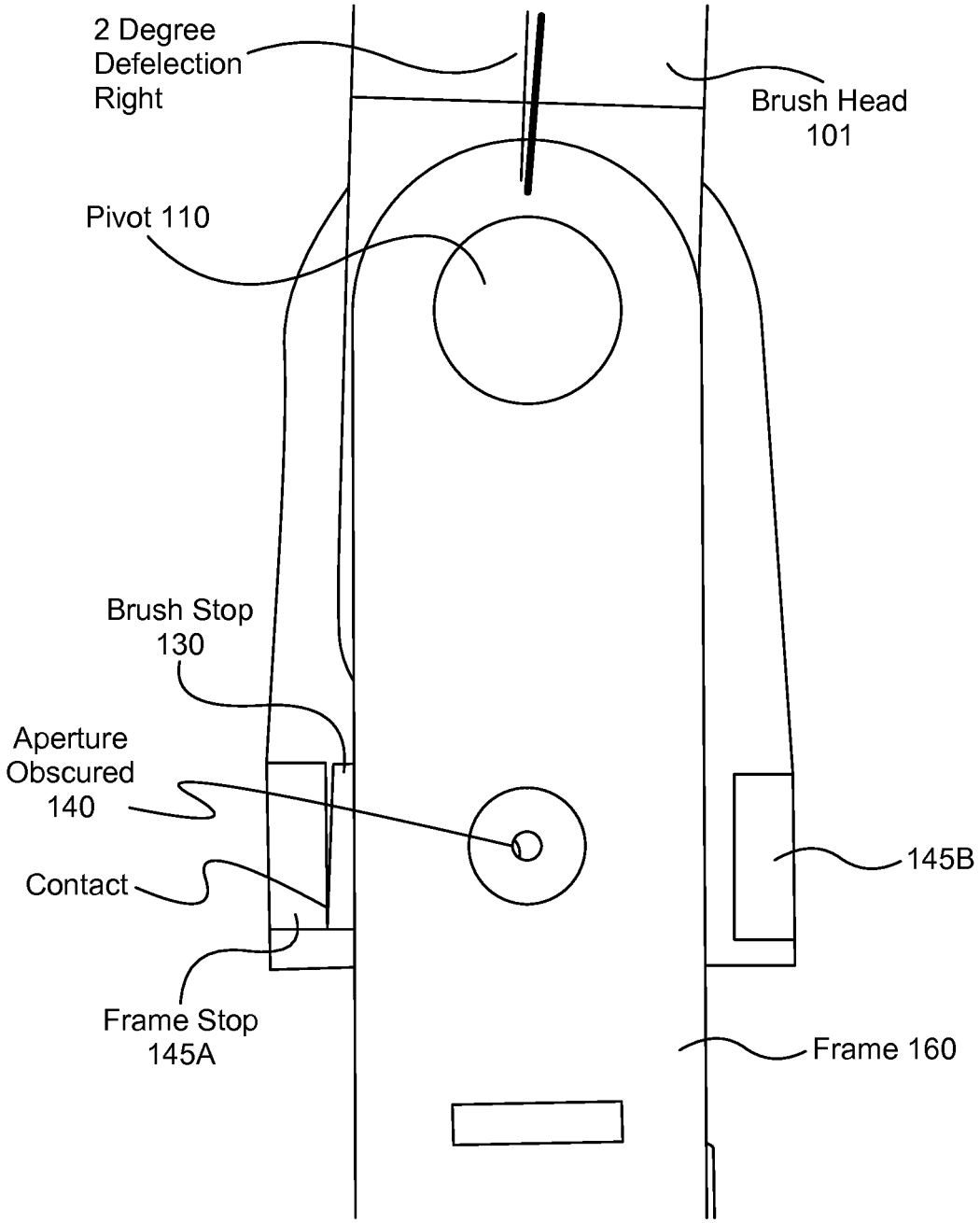
FIG. 4B shows a two degree offset brushing sensor aperture.

FIG. 4B shows a two degree offset brushing sensor aperture for the structure discussed above in FIG. 4A. The brush head 101 is shown against the left contact 145A. The preferred embodiment limits the throw to 2 degrees in either direction. This will provide very limited movement between the brush head 101 and the frame 160. By having this movement be limited, the user will not be distracted by the motion. It will be appreciated that other degrees of freedom are possible within the scope of this invention.

Figure 5:
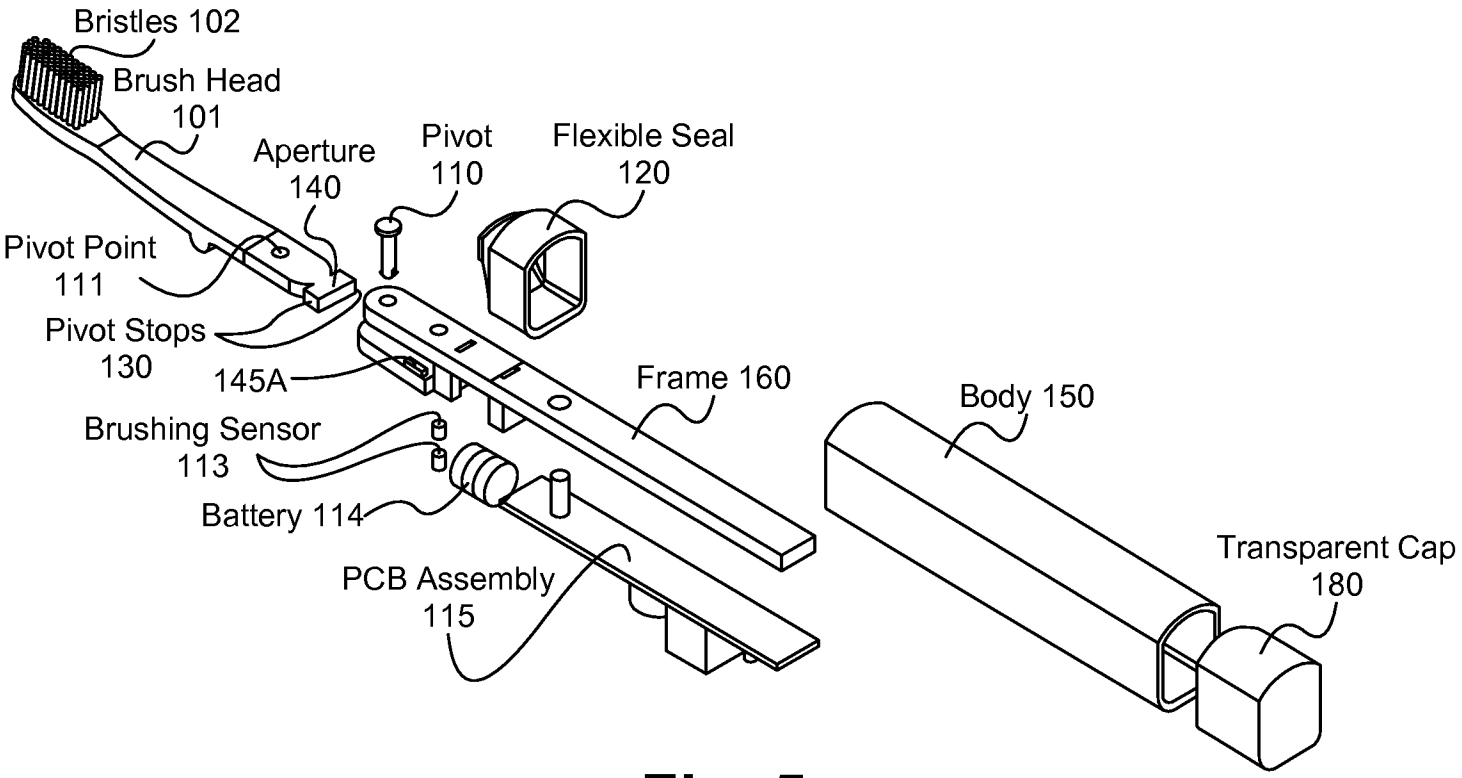
FIG. 5 shows an exploded view of the self-contained, interactive gaming oral brush of the present invention.

FIG. 5 shows an exploded view of the self-contained, interactive gaming oral brush 100 of the present invention. The brush head 101 inserts between the arms of the frame 160 such that the pivot stops 130 are positioned between the contacts 145A-B on the frame 160. The pivot 110 inserts into the pivot point 111 of the brush head 101. This allows the distal end of the brush head 101 to move slightly between the contacts 145A-B. An optical transmitter (e.g., 151, FIG. 7) is mounted on one side of the brush head 101 into the frame 160. An optical receiver (e.g., 152, FIG. 7) is mounted on the other side of the brush head 101 into the frame 160. An aperture 140 is formed through the distal end of the brush head 101 to allow light to pass therethrough from the optical transmitter to the optical receiver when the aperture 140 is aligned therebetween. In this way, as the brush head 101 moves from side to side, the optical signal will alternately pass from the optical transmitter to the optical receiver or be occluded depending upon alignment of the aperture 140 to the transmitter/receiver pair. It will be apparent that the transmitter/receiver pair could have been mounted along an edge of the distal end of the brush head 101. In such an alternative, the edge of the brush head 101 would alternately block and allow light to pass from the optical transmitter to the optical receiver.

An electronic assembly is also mounted to the frame. Preferably, the electronic assembly includes a power source of one or more batteries (e.g., 114, FIG. 7), a printed circuit board (PCB) (e.g., 115, FIG. 7), a processor (e.g., 185, FIG. 7) and, memory, whereby the memory can be formed integrally with the processor and a speaker 171. The transmitter/receiver pair (e.g., 151/152, FIG. 7) will be coupled to provide input to the processor. A tilt sensor (e.g., 187, FIG. 7) is also coupled to the electronic assembly.

When a user is properly brushing, the brush handle 150 is held substantially horizontal and the brush bristles 102 are projected at a 45° angle against their teeth, up and down and into the region where the teeth project from the gums, such that the optical signal from the optical transmitter of the sensor will alternately pass and be blocked. By sensing this alternating condition, the processor can determine that proper brushing is underway. Alternatively, if the user is brushing into and out of their mouth along their teeth the light pattern sensed by the optical receiver will not change, or will change much more slowly and the processor will determine that the user is improperly brushing their teeth.

Figure 7:
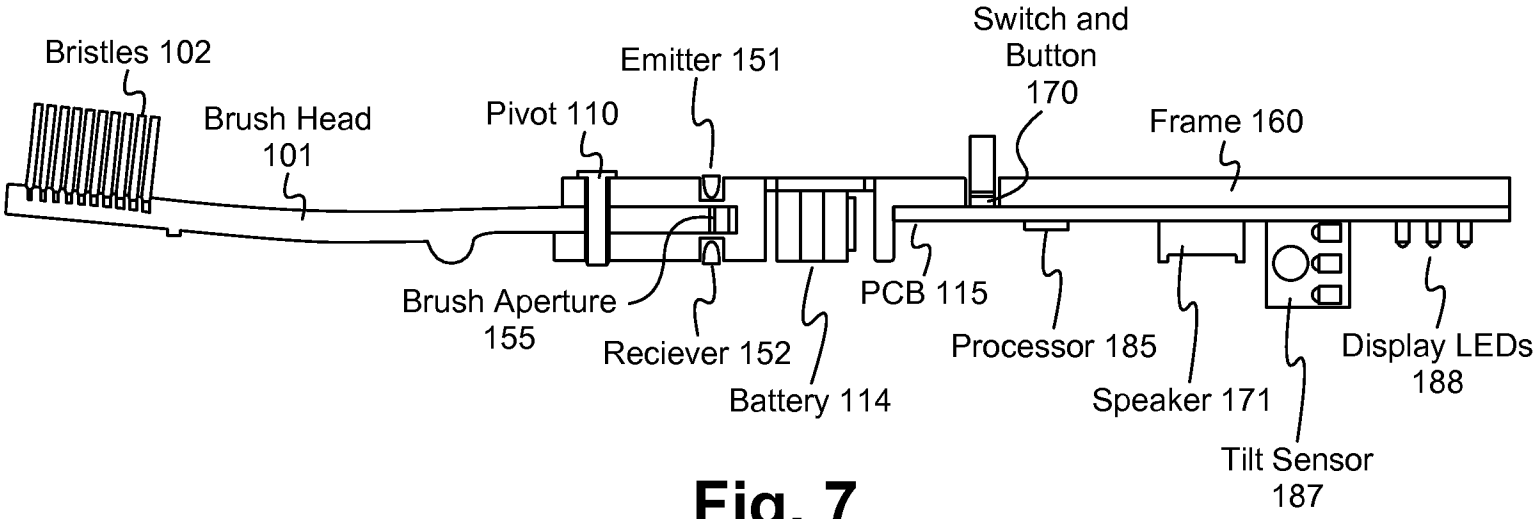
FIG. 7 shows a cross-section view of the self-contained, interactive gaming oral brush of the present invention.

The tilt sensor 187 can be a three dimensional sensor as shown in FIG. 7. In the preferred embodiment there are five sensors. These sensors sense the valid brushing positions. Thus, it can determine whether the brush is oriented toward the left teeth, or the right teeth or is vertically aligned. These same sensors can be further used to verify that the user is spitting, rinsing the brush or for mode selection for a richer experience.

In a gaming mode, the processor will instruct the user to brush one portion of their mouth, e.g., upper right teeth. When the user is instructed to switch positions, or spit, the processor will detect the change by the tilt sensor 187. Thereafter, the process will use the optical transceiver/receiver pair to detect proper brushing.

Figure 6:
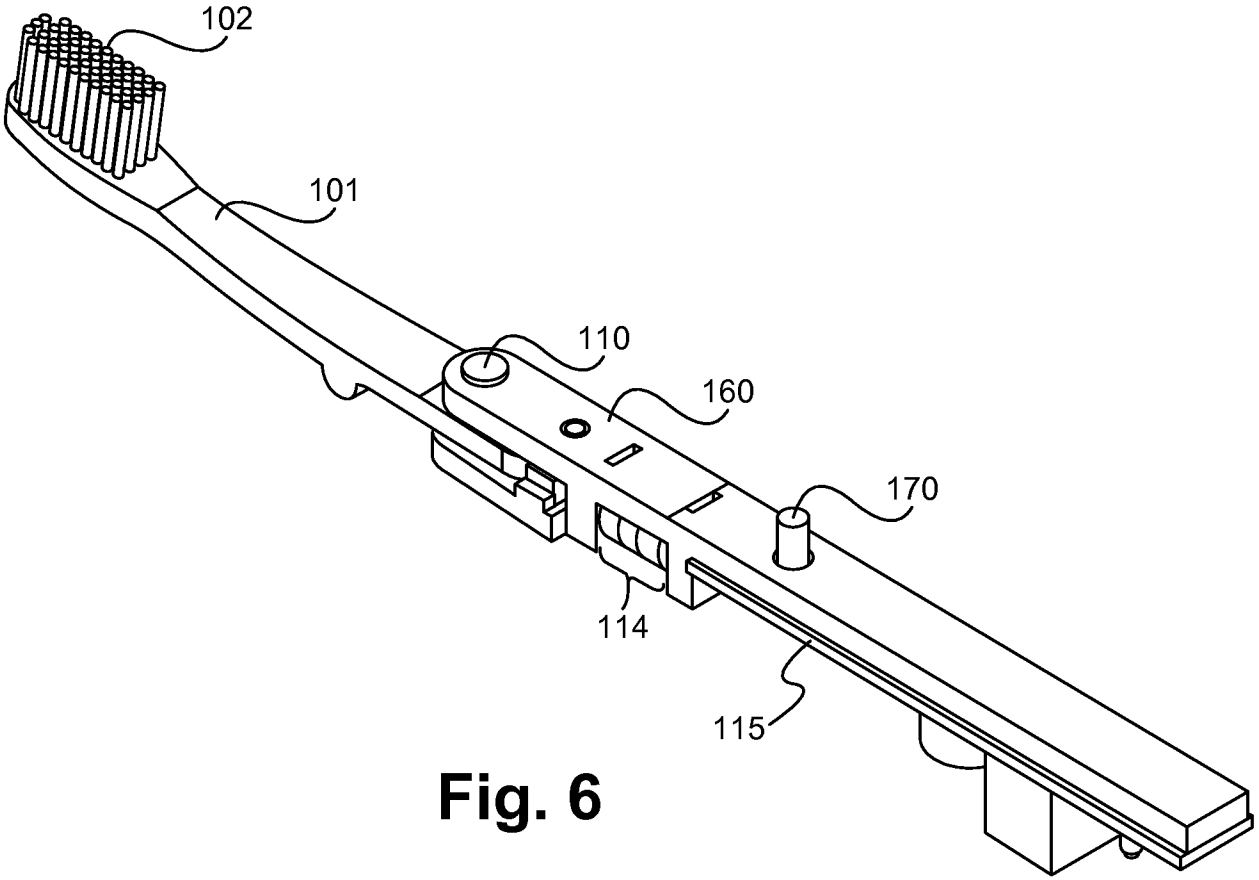
FIG. 6 shows a sub-assembly view of the self-contained, interactive gaming oral brush of the present invention.

FIG. 6 shows a sub-assembly view of the self-contained, interactive gaming oral brush 100 of the present invention.

FIG. 7 shows a cross-section view of the self-contained, interactive gaming oral brush 100 of the present invention. The device can include one or more light sources 188. The light sources 188 are preferably LEDs due to low power consumption and reliability. The light sources 188 can provide information such as by displaying a cadence, e.g., one flash for good or three flashes for bad brushing motion. Alternatively, the light sources 188 can include more than one color, e.g., red, green and blue and provide information according to color.

In normal operation of the present invention, the user would apply toothpaste to the bristles 102 of the brush 100 and press the switch 170 to start the game. The processor 185 would acknowledge the button press and instruct the user to begin brushing in an entertaining manner. The gaming brush would then detect the orientation of the brush 100 via the tilt sensors 187 and determine whether there is correct brushing motion. This sensed information would describe frequency, duration and location of the user's actions and, if appropriate, would detect the motion expected by the game. If the motion meets the requirements of the game logic, then the processor 185 will reward the user with appropriate game point(s) and positive feedback via audible and/or visual indication. Conversely, if the motion does not meet the requirements of the game logic, then the user will not accrue points. Negative audible and/or visual feedback will prompt the user to correct errant actions. Typically, the user will also be instructed to brush at a nominal speed; not too fast or too slow for best brushing efficacy.

Scores accrued during the brushing activity can be stored and then transmitted to other devices via audio chirping or visual flashing if the receiving apparatus had either a microphone or camera, respectively. For example, if the receiving apparatus is a so-called smart phone or tablet computer, it will have an integral microphone. It will be possible for the processor 185 to transmit a series of beeps from the brush 100 to the smart phone, wherein the series of beeps is encoded to contain information. For some smart phones, the microphone is able to receive sounds that are above the normal range for human hearing, namely ultrasonic sounds. By transmitting the data as ultrasonic signals, the transmission will not annoy the user or interfere with other activities. The smart phone will include an application program configured to receive and interpret data signals received via the microphone.

Moreover, the smart phone can have a camera. The device can be configured to emit a sequence of light signals which can be encoded to contain information from the device to the smart phone. If the camera is able to receive infrared signals which are outside the spectrum visible to the normal human eye, the device can also include an infrared LED. By transmitting data as infrared signals, the transmission will not annoy the user or interfere with other activities. The smart phone will include an application program configured to receive and interpret data signals received via the camera.

Figure 8:
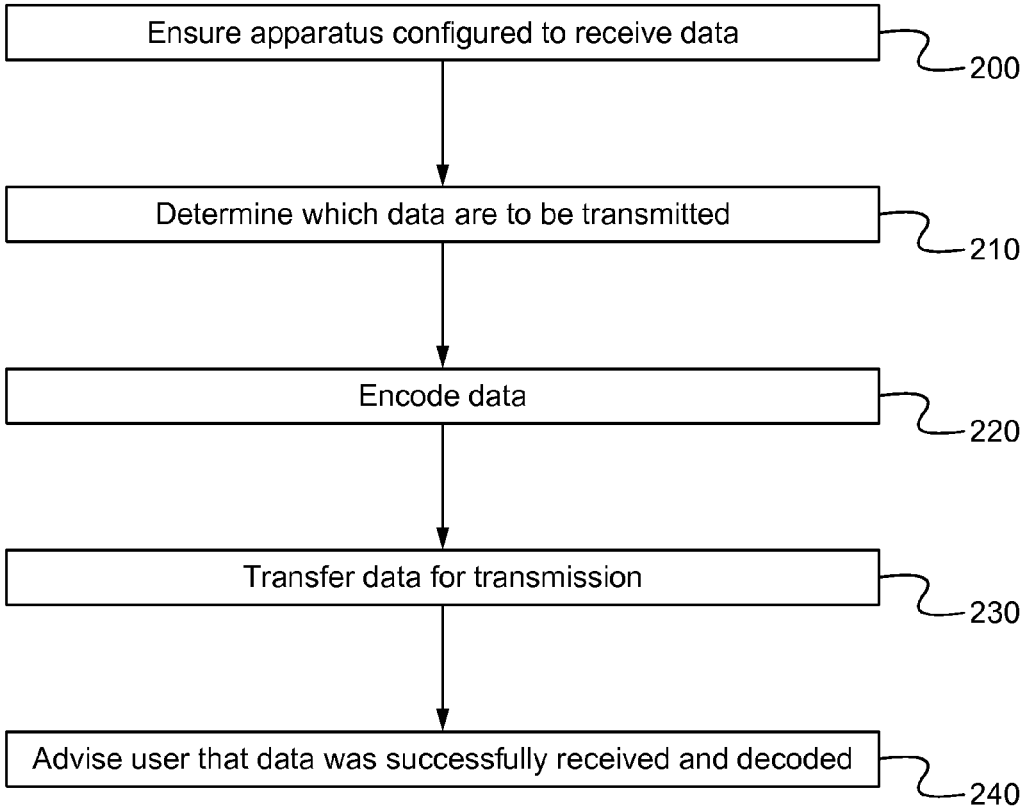
FIG. 8 shows a flow chart representing a data technique according to the present invention.

FIG. 8 shows a flow chart for data transmission. In the step 200, a user ensures that the receiving apparatus is configured to receive the data. Generally, this will entail the user invoking an application program on the receiving apparatus, such as a smart phone. This can be in response to the device prompting the user, such as with an audible prompt via the speaker 171. In the step 210, the processor 185 determines which data are to be transmitted. In the step 220, the processor 185 encodes the data. In the step 230, the processor 185 transfers the data for transmission. This transfer can be to the speaker 171 to transmit sound or ultrasound signals. Alternatively, this transfer can be to the light source 188 to transmit visible or infrared light. Still further, this transfer can be to both the speaker 171 and light source 188. The transfer can occur automatically or can be triggered by the user. The user can trigger the transmission by holding the brush 100 in a predetermined manner for mode selection by the tilt sensors 187, or by holding the power button 170 for an extended time, such as three seconds. In the step 240, the receiving apparatus can advise the user that data was successfully received and decoded.

The data transmission mode described above is a one-way transmission. For systems where the receiving apparatus includes a microphone, camera or both, it can provide a very low cost means to transmit information. It is recognized that there is a current trend to include electronics including a level of intelligence into a large variety of products which previously did not include electronics. This so-called "internet of things" typically relies on communicating from the device using BlueTooth®, WiFi, or a wired connection.

Alternatively, the device can have a cartridge that allows for removable or replaceable game upgrades or to download data from the game. Still further, the device can include a USB port that allows for removable or replaceable game upgrades or to download data from the game.

While the preferred embodiment discloses sensing brushing motion using a pivot and an optical transmitter/receiver pair, it will be apparent to one of ordinary skill in the art that brushing motion can be sensed using magnetic sensing, piezo-electric sensing or a strain gauge.

One of ordinary skill in the art will realize other uses and advantages also exist. While the invention has been described with reference to numerous specific details, one of ordinary skill in the art will recognize that the invention can be embodied in other specific forms without departing from the spirit of the invention. Thus, one of ordinary skill in the art will understand that the invention is not to be limited by the foregoing illustrative details, but rather is to be defined by the appended claims.

What is claimed is:

1. An oral care brush comprising:
- a brush head having bristles and an aperture;
- a handle coupled to the brush head at an articulation point; and
- a sensor for monitoring the articulation point to determine whether a brushing motion is proper, wherein the sensor includes:
  - an optical transmitter for transmitting an optical signal; and
  - an optical receiver which receives the optical signal when the aperture is aligned between the optical transmitter and the optical receiver.

2. The oral care brush according to claim 1 further comprising a tilt sensor mounted in the handle for determining an orientation of the brush for further refining a determination regarding brushing motion.

3. The oral care brush according to claim 2 wherein the tilt sensor comprises a three dimensional tilt sensor.

4. The oral care brush according to claim 3 wherein the three dimensional tilt sensor comprises five sensors.

5. The oral care brush according to claim 3 wherein the three dimensional tilt sensor can be used for mode selection.

6. An oral care brush comprising:
- a brush head having bristles and an aperture;
- a handle coupled to the brush head at an articulation point;
- a sensor for monitoring the articulation point to determine whether a brushing motion is proper, wherein the sensor includes:
  - an optical transmitter for transmitting an optical signal; and
  - an optical receiver for sensing a light pattern that is formed by the optical signal alternating between passing and not passing the aperture;
- a processor mounted within the handle for receiving information from the sensor; and
- a speaker in the handle, coupled to receive information from the processor and for providing audio feedback to a user regarding brushing technique.

7. The oral care brush according to claim 6 wherein the processor delivers a game play scenario to the user.

8. The oral care brush according to claim 7 wherein a score is given to the user that is representative of their brushing efficacy.

9. The oral care brush according to claim 6 further comprising a tilt sensor mounted in the handle for determining an orientation of the brush for further refining a determination regarding brushing motion.

10. The oral care brush according to claim 9 wherein the tilt sensor comprises a three dimensional tilt sensor.

11. The oral care brush according to claim 10 wherein the three dimensional tilt sensor comprises five sensors.

12. The oral care brush according to claim 10 wherein the three dimensional tilt sensor can be used for mode selection.

13. An oral care brush comprising:
- a brush head having bristles;
- a handle coupled to the brush head at an articulation point;
- a sensor for monitoring the articulation point to determine whether a brushing motion is proper, wherein the sensor includes:
  - an optical transmitter for transmitting an optical signal; and
  - an optical receiver for receiving the optical signal when the brush head and the handle are rotated relative to one another at the articulation point in a predetermined manner;
- a processor mounted within the handle for receiving information from the sensor; and
- a speaker in the handle, coupled to receive information from the processor and for providing audio feedback to a user regarding brushing technique and game-play scenarios for enhancing a brushing experience.

14. The oral care brush according to claim 13 wherein the processor delivers a game play scenario to the user.

15. The oral care brush according to claim 14 wherein a score is given to the user that is representative of their brushing efficacy.

16. The oral care brush according to claim 13 further comprising a tilt sensor mounted in the handle for determining an orientation of the brush for further refining a determination regarding brushing motion.

17. The oral care brush according to claim 16 wherein the tilt sensor comprises a three dimensional tilt sensor.

18. The oral care brush according to claim 17 wherein the three dimensional tilt sensor comprises five sensors.

19. The oral care brush according to claim 17 wherein the three dimensional tilt sensor can be used for mode selection.

20. An oral care brush comprising:

a brush head having bristles;

a handle coupled to the brush head at an articulation point; and a sensor for monitoring the articulation point to determine whether a brushing motion is proper, wherein the sensor for monitoring the articulation point is an optical sensor that utilizes:

an optical transmitter/receiver pair comprising:

an optical transmitter mounted to a first side of the brush head; and an optical receiver mounted to a second side of the brush head, wherein the first side and the second side are on opposite sides of the brush head; and an aperture formed through an end of the brush head to allow an optical signal to pass therethrough from the optical transmitter to the optical receiver when the aperture is aligned therebetween, wherein as the brush head moves side to side when the oral care brush is in use, the optical signal from the optical transmitter alternate between passing to the optical receiver and being occluded depending upon the alignment of the aperture and the transmitter/receiver pair, thereby forming a light pattern, wherein the determine determining of whether a brushing motion is proper is based on the light pattern.

* * * * *